United States Patent [19]

Gibbons et al.

[11] Patent Number: 5,051,056

[45] Date of Patent: Sep. 24, 1991

[54] PORTABLE BOAT JACKING AND ROTATING APPARATUS

[75] Inventors: Robert R. Gibbons; Dennis Fried, both of Bismarck, N. Dak.

[73] Assignee: G. F. Equipment, Inc., Baldwin, N. Dak.

[21] Appl. No.: 463,131

[22] Filed: Jan. 10, 1990

[51] Int. Cl.[5] ..... B63C 13/00

[52] U.S. Cl. ..... 414/678; 414/590; 269/17; 269/60; 269/68; 269/296; 248/201; 254/7 B; 254/134

[58] Field of Search ..... 414/590, 678, 607, 608, 414/620, 634, 638, 639, 668, 458; 254/4 B, 6 B, 7 B, 134; 269/17, 61, 60, 71, 68, 296; 248/201, 200.1

[56] References Cited

U.S. PATENT DOCUMENTS

| | | | |
|---|---|---|---|
| 2,419,813 | 4/1947 | Berchtold | 212/57 |
| 2,849,124 | 8/1958 | Warner . | |
| 2,997,292 | 8/1961 | Lucker et al. | 269/112 |
| 3,218,056 | 11/1965 | Kaplan et al. | 269/17 X |
| 3,428,191 | 2/1969 | Newswanger . | |
| 3,700,132 | 10/1972 | Waters . | |
| 4,090,625 | 5/1978 | Walters . | |
| 4,183,511 | 1/1980 | Marek | 269/17 |
| 4,239,196 | 12/1980 | Hanger | 269/17 |
| 4,396,343 | 8/1983 | Brewer | 414/758 X |
| 4,599,034 | 7/1986 | Kennedy et al. | 414/678 |

FOREIGN PATENT DOCUMENTS 926297 4/1955 Fed. Rep. of Germany ..... 414/458

*Primary Examiner*—Frank E. Werner
*Assistant Examiner*—Brian K. Dinicola
*Attorney, Agent, or Firm*—Schroeder & Siegfried

[57] ABSTRACT

An apparatus for suspending and rotating a boat about its longitudinal axis in either direction, including a pair of movable and adjustable support frames having connecting arms which are designed to rotatably engage the support eyes (also known as ski tow eyes, wench eyes or mooring eyes) on the rear and front ends of the boat. The rear support frame includes a rotatable shaft upon which the rear end connecting arms are rigidly mounted so as to be capable of rotating the boat about its longitudinal axis. The rear support frame also includes a base frame with a pair of extensible legs which are adjustable to support and balance varying sizes of boats. Each support frame includes a hoist for causing vertical movement of the connecting arms which support the boat. The front end support frame is constructed so as to define a passageway therethrough to facilitate removal of the boat trailer upon which the boat rests, once the boat is hoisted therefrom. The front support frame is also constructed with a pair of extensible base legs which are adjustable to support and balance varying sizes of boats. Each frame is capable of being readily broken down into a plurality of pieces for easy storage and transportation, and easily re-assembled when desired.

25 Claims, 5 Drawing Sheets

3
108
109
121
111
117
113
115
107
108
109
119
101
93
122
103
97
105
51
129
99
139
131
127
141
125
95
137
135
123
133
51
51
110
7
7
51
51
7
110
7

143
149
145
151
153
147
137
135
151

155
137
135
151
155

PORTABLE BOAT JACKING AND ROTATING APPARATUS

BACKGROUND OF THE INVENTION

The invention disclosed herein is related generally to a novel and useful apparatus which is specifically designed to suspend and rotate boats of varying sizes about their longitudinal axes. More particularly, the invention disclosed herein is directed toward an apparatus which is capable of suspending and supporting a boat solely by the support eyes mounted on the rear and front ends thereof, and rotating the boat about its longitudinal axis to facilitate ease in cleaning, repairing or displaying the hull of the boat, as well as the interior thereof.

Boats which are in need of repair or cleaning are commonly hoisted from the water by means of a boat trailer which is attached to a vehicle for pulling the same. It is extremely difficult for a repairman to work around and under the frame of the boat trailer when cleaning or repairing a boat resting thereon. The supports on the boat trailer quite often cover a good portion of the bottom of the boat, thereby making it difficult or impossible to clean the entire bottom surface of the boat. Moreover, if repair is needed, the repairman must position himself in ackward positions in order to work around the frame of the boat trailer, and crawl underneath the boat and trailer for access to the bottom surface thereof. It is readily apparent from the above that there is a distinct need for an apparatus which can readily remove a boat from a boat trailer and suspend and rotate the boat, while allowing the boat trailer to be removed from thereunder.

Attempts have been made in the past to design a system for suspending and rotating a boat about its longitudinal axis, but such systems have not proved adequate. One such apparatus involves the use of a pair of reinforced straps which wrap around the boat tightly and enables the operator to turn the boat about its longitudinal axis. The most obvious fault with this system is that the straps tend to cover an appreciable area of the hull of the boat so as to prohibit the operator from cleaning or repairing such areas.

Another system for suspending and rotating a boat about its longitudinal axis is shown in U.S. Pat. No. 2,997,292, issued to Lucker et al on Aug. 22, 1961. The apparatus in this patent is designed to suspend from opposite ends a row boat or other boat which is specifically adapted for outboard motors. One obvious problem with the apparatus shown in this patent is that it is limited in its applications (boats with outboard motors only), and requires that the outboard motor be removed from the boat prior to use of the apparatus. Moreover, it would be impossible through use of the apparatus shown in this patent to properly position the hoist at opposite ends of the boat while the boat rests on a boat trailer. The portion of the boat trailer extending beyond the front end of the boat would obstruct the positioning of the front hoist. Thus, any boat used with the boat jack shown in this patent must be removed from its boat trailer by some means and allowed to rest on the ground prior to connecting the boat jack thereto. Under such conditions, the hull of the boat can easily be damaged, thereby necessitating the need for further undesirable repairs.

It is evident from the above that there is a distinct need for an apparatus which suspends and rotates a boat about its longitudinal axis which can be used to support a variety of different types of boats without obstructing or covering portions of the hull which may need to be cleaned or repaired. It is also evident from the above that there is a distinct need for an apparatus for suspending and rotating a boat about its longitudinal axis which is designed to accommodate a boat upon its boat trailer such that the boat rotating apparatus may be positioned in proper boat-supporting relation without removal of the boat from the trailer. With such proper positioning, the boat may be lifted directly off the boat trailer so as to allow the boat trailer to be readily removed from thereunder.

It is the object of this invention to provide such an apparatus for suspending and rotating a boat about its longitudinal axis which is capable of supporting a variety of different types and sizes of boats and is designed to accommodate, connect to and lift such boats directly off their boat trailer so as to allow the boat trailer to be removed from thereunder.

BRIEF SUMMARY OF THE INVENTION

My new portable boat rotative mount is basically comprised of a pair of movable and adjustable frames, one of which is disposed at the rear end of the boat and the other at the front, such frames being specifically designed such that they can be easily transported and placed into proper position for connection to the boat prior to removing the boat from the boat trailer. The rear support frame has a pair of extensible connecting arms which are also adjustable and reversible to accommodate varying types and sizes of boats. The extensible portion of each connecting arm of the rear support frame includes a rotatable coupling head which is designed to connect to one of the eye bolts or support eyes which are mounted on opposite sides of the transom on the rear end of the boat.

Such support eyes are commonly found on a majority of small and medium sized boats of all types, and are capable of supporting the weight of the boat. Notwithstanding the above, it is preferred that a pair of L-shaped support brackets be used at the connection to the support eyes to transfer a portion of the weight of the boat across a larger surface area of the boat transom. By connecting to the support eyes and utilizing such support eyes to lift and suspend the boat for rotation thereof, it can be seen that a wide variety of boats can be used with my invention. Moreover, no straps or other obstruction need be wrapped around the hull of the boat. As such, the entire hull of the boat can be easily worked on without obstruction.

The rear support frame has a base frame with extensible legs which are mounted on wheels so as to be easily transportable. Extending upwardly from the base frame is a mast which carries a slidable sleeve to which a rotatable shaft is mounted. The adjustable connecting arms are fixedly mounted to the rotatable shaft which is controlled via a manual crank or other means so as to control the rotation of the boat about its longitudinal axis. The connecting arms are vertically movable via a chain hoist (or any other suitable means which can lift the same—e.g. compressed air, hydraulics, rope, etc.) which is connected to the slidable sleeve that carries such arms.

The front support frame is designed such that it forms a passageway or archway path which facilitates and allows proper positioning of the frame for connection to the boat without removal of the boat from the boat trailer, and facilitates removal of the boat trailer once the boat is hoisted therefrom. After positioning the front and rear support frames in proper boat-supporting relation, the boat may be connected to the support frames and lifted directly off the boat trailer, thereby allowing the boat trailer to be removed from thereunder.

The front support frame also includes an extensible connecting arm with a rotatable coupling head at the end thereof. Similar to the connecting arms on the rear support frame, the connecting arm of the front support frame is designed to rotatably connect to the support eye located on the front end of the boat. Similar in construction to the rear connecting arms, the front connecting arm is mounted to the front support frame in vertically slidable relation. Each support frame includes a hoist mechanism, such as a chain hoist, which is used to raise and lower their respective connecting arms. As such, the rear and front ends of the boat may be raised and lowered through use of such hoists. The front support frame has extensible telescoping base legs for increased support, and is also mounted on wheels so as to be readily transportable. Each support frame includes a boom which extends outwardly toward the boat to be supported thereby. Such booms may be used for removal or installation of heavy objects such as boat engines.

Through use of my new invention, any small or medium sized boat having support eyes on their rear and front ends may be lifted directly off a boat trailer, and suspended and rotated in mid-air about its longitudinal axis for easy access to all portions of the boat.

DETAILED DESCRIPTION OF THE INVENTION

Figures 1, 1A:
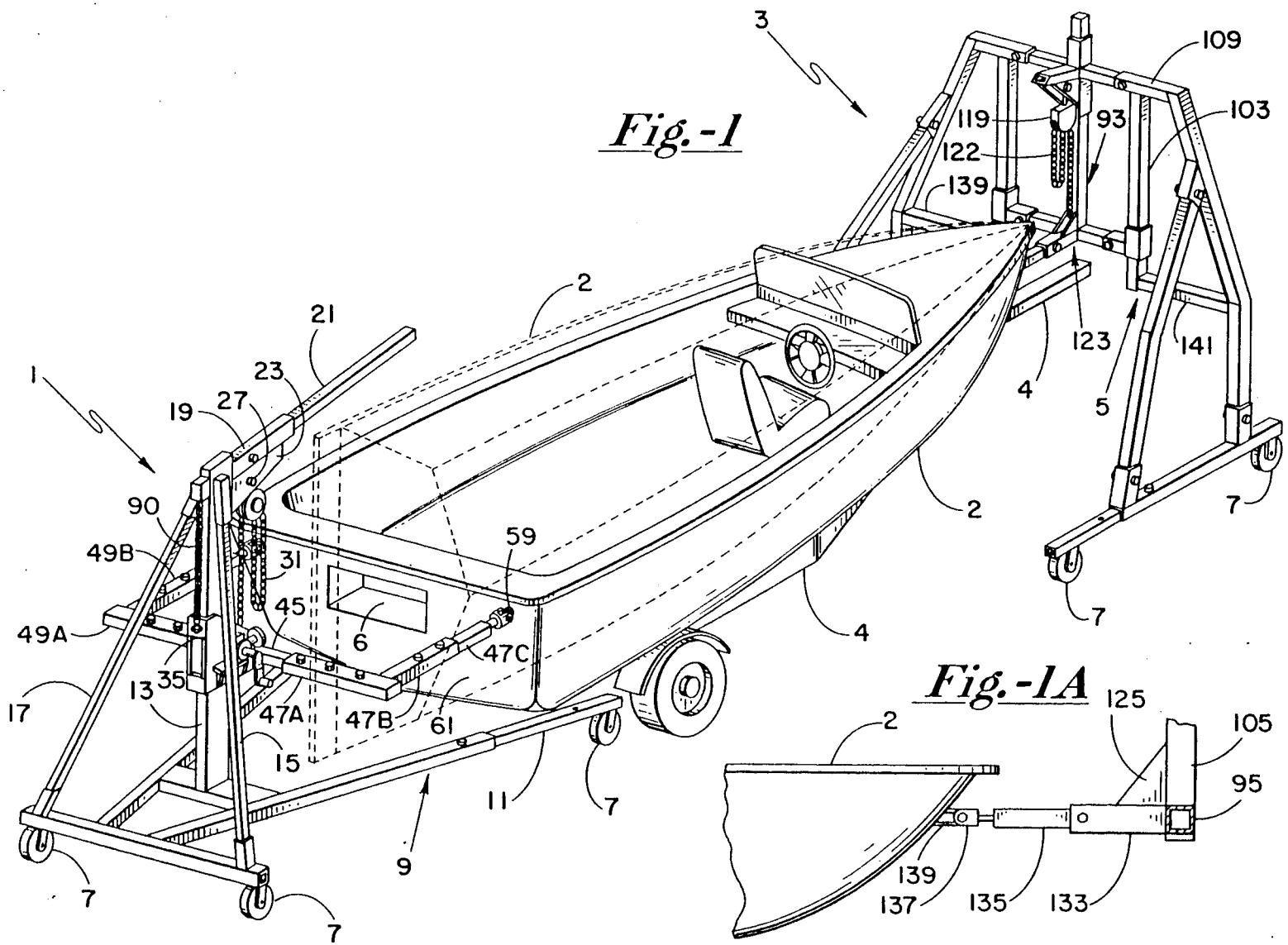
FIG. 1 is a perspective view of my new Boat Rotative Mount showing a typical boat being connected to and supported by the front and rear support frames thereof.
FIG. 1A is fragmentary side elevation of the front end of a boat which is connected to the front support frame of my new Boat Rotative Mount.

As shown in FIG. 1, my improved boat rotative mount is comprised generally of a rear and front end support member or frame, 1 and 3 respectively, which are designed to support and hoist a boat 2 for rotation thereof solely by the support eyes of the boat. As can be seen further from FIG. 1, the support frames 1 and 3 are specifically designed so that they may be properly positioned for connection to a boat 2 without removing the boat from a boat trailer 4. Moreover, the front support frame 3 is designed such that an archway path 5 is formed thereby so that the boat trailer 4 may be removed once the boat 2 is supported and hoisted from the same.

The boat 2 shown in FIG. 1 is for illustrative purposes only. In order to simplify and avoid cluttering the drawings with unnecessary details, the boat 2 is shown devoid of an engine or lower drive unit. It should be understood, however, that my Portable Boat Rotative Mount is specially designed to accommodate a wide variety of types of boats such as inboards, inboards/outboards and outboards. The boat 2 is shown with a rear opening 6 to signify that generally a lower drive unit would extend outwardly therefrom, as in the case of an inboard/outboard. The important point is that the boat 2 be equipped with a pair of rear support eyes 59 connected to the transom 61 of the boat 2, and a similar front-end support eye 139, to facilitate connection to the respective rear and front support frames 1 and 3.

Each support frame 1 and 3 is transportable and movable via wheels 7 which are mounted on the base portions thereof. As shown in FIG. 1, the A-frame base member 9 of the rear support frame 1 has extensible leg portions 11 which are adjustable so as to accommodate and help balance varying sizes and shapes of boats. Although not shown in the drawings, it is conceivable that the front support frame 3 may also be designed with an adjustable or extensible base frame. Through the use of my improved boat rotative mount, many different types and sizes of boats may be supported and rotated at least 180° in either direction about their longitudinal axis for ease of access to both the exterior and interior thereof when cleaning or repairing same.

Figure 2:
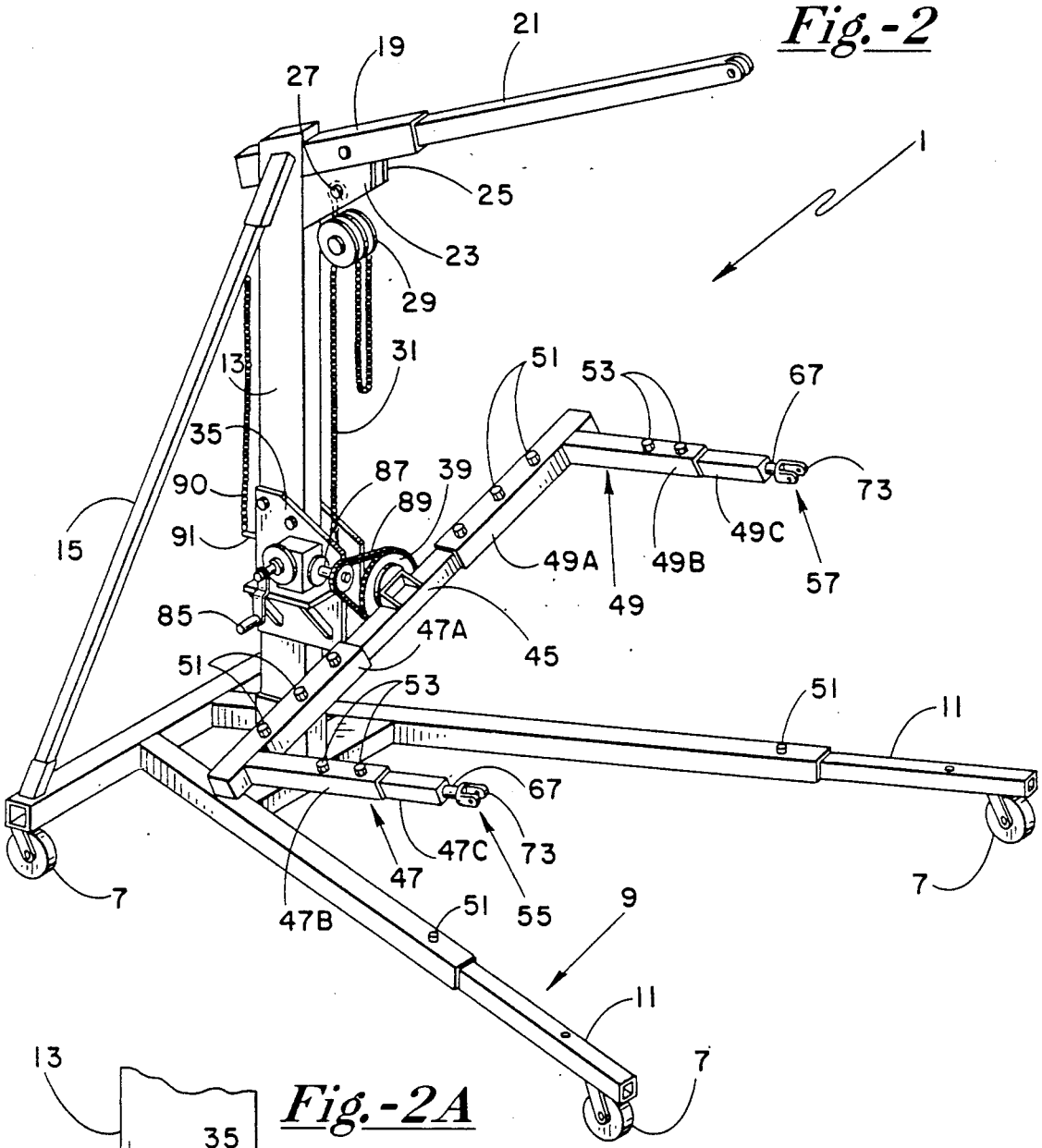
FIG. 2 is a perspective view of the rear support frame of my new Boat Rotative Mount showing the rotatable connecting arms which support and rotate a boat connected thereto.

As best shown in FIG. 1 and FIG. 2, the rear support frame 1 is comprised of a movable and adjustable A-frame base 9 which supports an upstanding mast 13. For added strength, mast 13 is supported at its upper end to the base frame 9 by struts 15 and 17 which are securely connected therebetween. The top end of mast 13 carries a boom sleeve 19 which extends outwardly and upwardly from the mast 13 in a direction toward the boat 2 to be supported thereby. Boom sleeve 19 is designed to accommodate a removable boom 21 which extends over the rear portion of the boat so that an operator thereof may use the boom 21 to lift such heavy objects as boat engines, etc. The boom sleeve 19 is supported on its underside to the mast 13 by a pair of support plates 23 and 25. Extending transversely between and through support plates 23 and 25 is mounting pin 27 which functions as a mount for chain hoist 29.

Figure 2A:
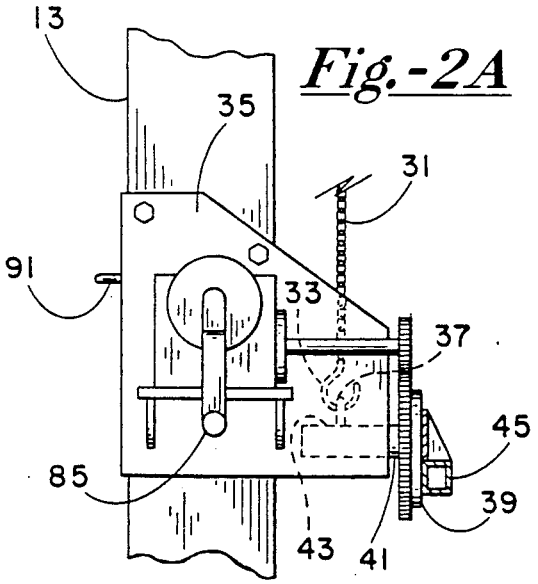
FIG. 2A is a fragmentary side elevation of the rear support frame of my new Boat Rotative Mount showing the vertically adjustable sleeve which carries the rotatable connecting arms of the frame.

As shown best in FIG 2A, chain 31 extending downwardly from chain hoist 29 has a hook 33 which connects to sleeve 35 through connecting eye 37 which is integrally formed with sleeve 35. Sleeve 35 is slidably mounted upon mast 13 for vertical movement thereon, such vertical movement being controlled by chain hoist 29 and chain 31. Through the use of chain hoist 29, sleeve 35 can be raised and lowered with relative ease, thereby raising and lowering the rear end of a boat 2 supported thereby.

Mounted on sleeve 35 and carried in rotatable rotation thereto is gear plate 39 with shaft 41 which is carried in cooperative rotatable relation within central opening 43 in sleeve 35. Gear plate 39 is disposed in a transverse plane relative to the longitudinal axis of the boat 2 to be supported and rotated thereby, thereby facilitating rotation about the boat's longitudinal axis. Fixedly mounted upon the front face of gear plate 39 is mounting bar 45 which carries a pair of connecting arms 47 and 49.

Connecting arms 47 and 49 are comprised further of tubular sleeves 47A and 49A which mount on opposite ends of mounting bar 45 and can be locked thereto via locking bolts 51. Connected to sleeve 47A and extending outwardly therefrom toward the boat 2 to be supported thereby is a second sleeve member 47B which slidably carries in telescoping relation an extensible portion 47C therewithin. The extensible portion 47C can similarly be locked into its desired position via locking bolts 53. Because connecting arms 47 and 49 are similarly constructed, a second sleeve 49B having an extensible portion 49C are also fixedly connected to sleeve 49A, and extend outwardly therefrom toward the boat 2 to be supported thereby.

Connecting arms 47 and 49 can be alternatively constructed with an upward 90° bend therein (not shown), such that the arms will be essentially z-shaped. This configuration of the connecting arms will lower the axis of pivot relative to the boat, which is sometimes beneficial, particularly when boats having a lower center of gravity are being hoisted and rotated.

Each connecting arm 47 and 49 have rotatable mounting heads 55 and 57 which are rotatably carried by extensible portions 47C and 49C, respectively. Rotatable heads 55 and 57 function to connect to the rear support eyes or eye bolts 59 which extend outwardly from and are connected to the transom 61 of the boat.

Figure 4A:
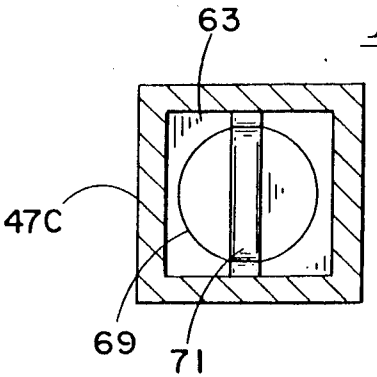
FIG. 4A is a sectional view of the connecting arm shown in FIG. 4, taken along lines 4A—4A.
Figure 4:
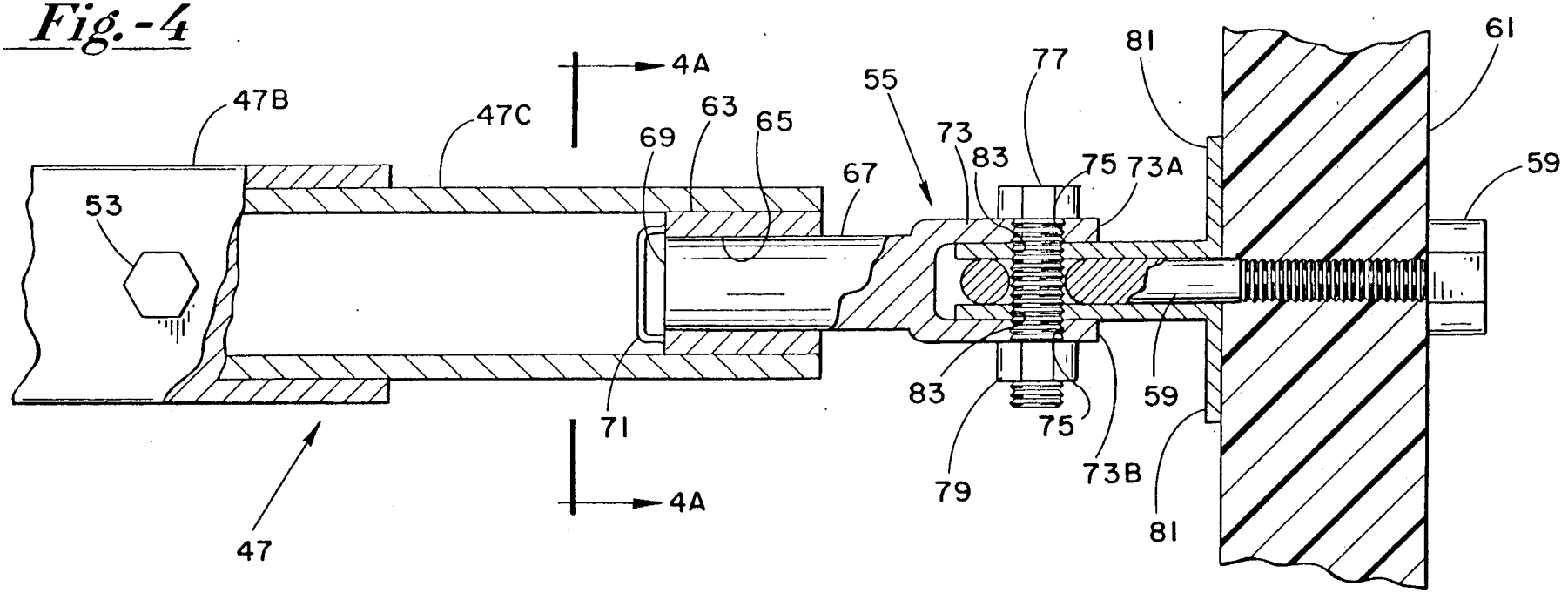
FIG. 4 is a fragmentary sectional side elevation of one of the rear-end connecting arms of the rear support frame of my new Boat Rotative Mount.

The specific construction of extensible portions 47C and 49C, and rotatable heads 55 and 57 are best shown in FIGS. 4 and 4A. For illustrative purposes, connecting arm 47 is shown in FIGS. 4 and 4A. It should be understood, however, that connecting arm 49 is constructed in a similar manner. As can be seen in the drawings, tubular sleeve members 47A and 47B are square in cross section, but it is conceivable that other cross-sectional configurations could also be used. Extensible portion 47C is constructed with outer dimensions which cooperate with the inner dimensions of tubular sleeve 47B, such that extensible portion 47C is telescopically slidable and insertable within tubular sleeve 47B.

The outer end of extensible portion 47C has a radially inwardly extending shoulder 63 which forms a central circular opening 65 therethrough. Central opening 65 is constructed to cooperatively receive in rotatable relation therein shaft 67 of rotatable head 55. Shaft 67 has a cap 69 fixedly secured to its inner end, said cap 69 having diametrical dimensions which are greater than the diameter of opening 65. As such, cap 69 rests upon shoulder 63 and prevents head 55 from being pulled out of extensible portion 47C. To further prevent longitudinal movement of rotatable head 55 along the axis of extensible portion 47C, a metal strap 71 extends over cap 69 and is welded to shoulder 63 of extensible portions 47C. The use of strap 71 prevents longitudinal movement of head 55 but freely allows head 55 to rotate within central opening 65.

Rotatable head 55 has at its outer end a U-bracket 73 which is constructed for connection to a support eye 59 of a boat. The U-bracket 73 has a pair of longitudinally extending opposed spaced arms 73A and 73B, each of which has a transverse opening 75 extending therethrough for accommodation of a mounting bolt and nut 77 and 79, respectively.

As can be readily seen from FIG. 4, for connection of the rotatable head 55 to one of the support eyes 59 of the boat, the support eye 59 is inserted between opposite arms 73A and 73B so that the opening through the support eye 59 is in cooperative alignment with opening 75 through said arm 73A and 73B. For added support and to dispurse the weight of the boat over a larger surface area on the transom 61 of the boat, L-shaped brackets 81 are preferably used in conjunction with rotatable head 55 to securely connect the respective connecting arm to the support eye 59 of the boat. Each L-shaped bracket 81 also has an opening which is disposed in cooperative alignment so as to be capable of receiving bolt 77 therethrough. Once the opening through arm 73A and 73B, brackets 81 and the support eye 59 are in proper alignment, bolt 77 can be inserted therethrough and receive nut 79 on the opposite end thereof so as to fixedly secure the respective connecting arm to the boat.

Figure 5:
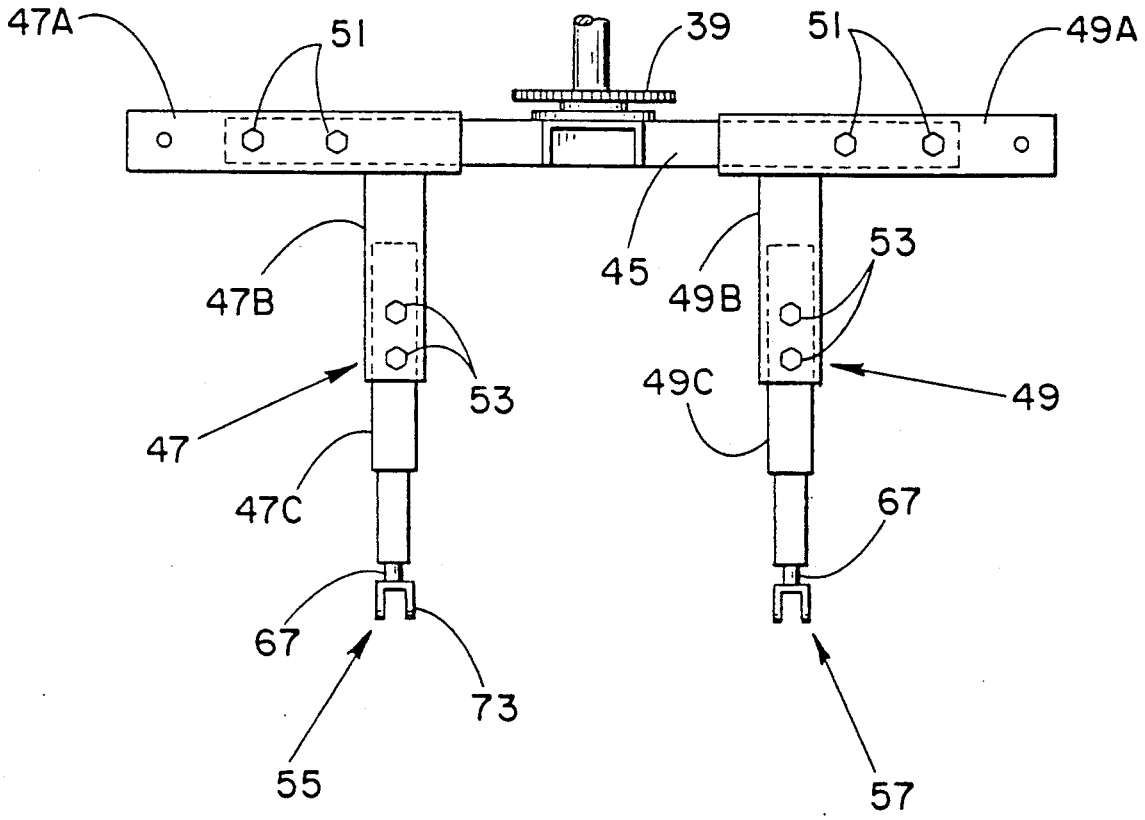
FIG. 5 is a top plan view of the rear connecting arms of our boat rotative mount, showing the reversibility thereof.

The rotational movement of head 55 allows the operator who is connecting a boat thereto to rotate head 55 into the proper position so that the support eye 59 of the boat can be easily inserted between the opposed arms of U-bracket 73, regardless of how the eye support 59 is mounted upon the transom 61 of the boat. It should also be noted, as is readily apparent from FIG. 5 of the drawings, that tubular sleeves 47A and 49A may easily be flipped over end to end about a transverse axis and reversibly mounted upon their respective ends of mounting bar 45, thereby making it possible to utilize such connecting arms with a variety of boat sizes having various widths.

Rotation of the mounting bar 45 and consequently the connecting arms 47 and 49 is effected through gear plate 39, which is rotatably mounted on vertically movable sleeve 35. Also mounted on sleeve 35 is a lockable manual gear crank mechanism 85 which rotatably controls pinion 87. Pinion 87 subsequently causes rotation of gear plate 39 through chain 89 which extends around both pinion 87 and gear plate 39 in controlling relation thereto. Thus, turning crank 85 can cause a rotation of mounting bar 45 and consequently connecting arms 47 and 49 in either direction about the longitudinal axis of the boat 2 carried thereby, up to at least 180°. As gear crank 85 controls the rotation of pinion 87, and consequently gear plate 39 and connecting arms 47 and 49, locking the gear crank 85 causes the connecting arms 47 and 49 to lock in any desired position.

The rear support frame 1 also includes a safety chain 90 which is fixedly connected at one end to the top of mast 13 and can be adjustably connected elsewhere along the chain to slidable sleeve 35. Once the sleeve 35 is properly positioned via chain hoist 29, safety chain 90 can be pulled taut and secured to catch 91 which is mounted upon the backside of sleeve 35.

Figure 3:
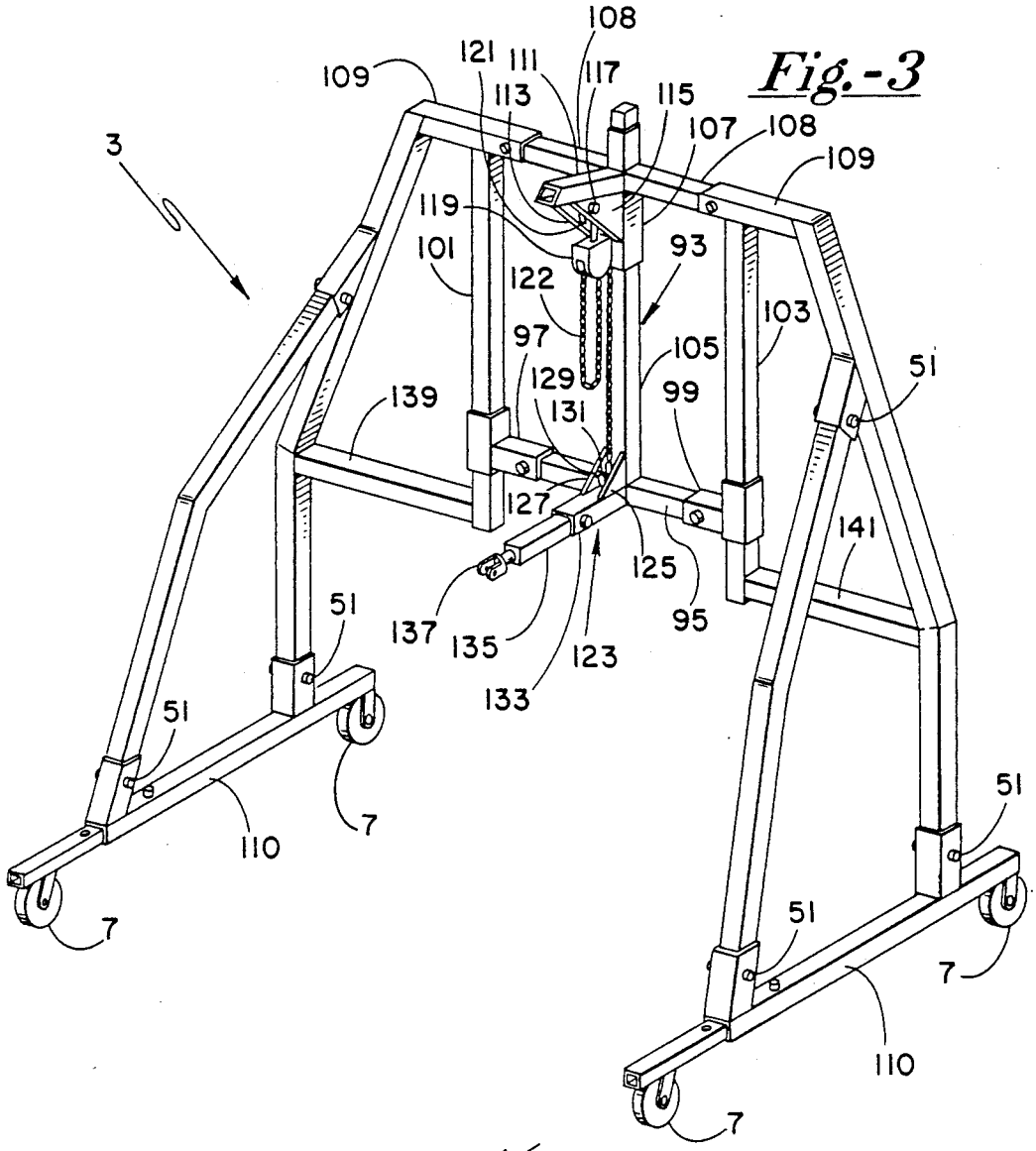
FIG. 3 is a perspective view of the front support frame of my new Boat Rotative Mount.

Turning now to the front support frame, as best shown in FIGS. 1 and 3, the front support frame 3 includes a slidably adjustable T-bar 93 which is centrally disposed and vertically movable upon frame 3.

The cross bar portion 95 of slidable T-bar 93 carries brackets 97 and 99 which slidably engage vertical support studs 101 and 103, respectively, of frame 3. Leg 105 of T-bar 93 extends upwardly from cross bar 95 through sleeve 107. Sleeve 107 has arms 108 which telescopically engage in lockable relation top support bars 109 of frame 3. The slidable engagement of brackets 97 and 99, and the slidable relation of leg 105 within sleeve 107 allows free vertical movement and adjustment of T-bar 93. Frame 3 includes a pair of extensible base members 110 which can be adjusted and locked at various lengths to provide increased support and balance, if needed. Each base member 110 includes a pair of wheels 7 to provide transportability to the support frame 3.

Mounted on sleeve 107 is a second boom sleeve 111 which extends upwardly and outwardly toward the boat 2 to be supported by frame 3. Boom sleeve 111 is supported by a pair of support plates 113 and 115 which are also fixedly connected to sleeve 107. Similar to the rear support frame 1, a mounting pin 117 extends transversely across and through support plates 113 and 115, and functions as a mount for the front chain hoist 119 via hook 121.

Chain 122 is carried by chain hoist 119 and extends downwardly therefrom to bracket 123 which is mounted on T-bar 93 at the junction between cross bar 95 and leg 105. Bracket 123 also has a pair of spaced support plates 125 and 127 with a mounting pin 129 extending thereacross and therethrough so as to provide a catch for hook 131 which is connected to the bottom of chain 122. With chain 122 connected to bracket 123, the vertical movement of T-bar 93 can be controlled through chain hoist 119. Similar to the rear support frame 1, the front support frame 3 includes a pair of safety chains (not shown), each of which is connected at one end to one of the top support bars 109 and adjustably connected at its other end to one of the slidable brackets 97 or 99.

As best shown in FIG. 1A and 3, bracket 123 includes a tubular sleeve portion 133 which functions in a similar manner to sleeve 47B and 49B of the rear connecting arms 47 and 49. Sleeve 133 is designed to slidably receive in lockable telescoping relation an extensible connecting arm 135 with a rotatable head 137, the construction and operation of which is identical to rear connecting arms 47 and 49. The rotatable head 137 of the front connecting arm 135 connects to the front support eye 139 of the boat in a similar manner to that described previously with respect to rotatable heads 55 on rear connecting arms 47 and 49.

Support studs 101 and 103 extend downwardly from respective top support bars 109 to a point approximately mid-way between ground level and top support bars 109. The bottom ends of support studs 101 and 103 connect to a pair of mid-section cross bars 139 and 141, respectively, of frame 3. Mid-section cross bars 139 and 141 add further support to frame 3 and also act as a stop for brackets 97 and 99 so as to prevent the same from becoming disengaged from support studs 101 and 103.

The front support frame 3 is specifically designed in the manner described above with the intention of providing a passageway or archway through the midportion thereof so as to be capable of accommodating a boat trailer 4 therethrough and thereunder. As best shown in FIG. 1, the front support frame can be transported and moved into its proper position for connection to the boat without having to remove the boat 2 from the boat trailer 4. Once the boat 2 is connected at both ends to the rear support frame 1, and to the front support frame 3, the boat may be hoisted directly from the trailer via chain hoists 29 and 119. The boat trailer may then be driven or pulled out from beneath the boat straight through the passageway defined by the front support frame 3. This is particularly advantageous when the boat being hoisted and rotated by my improved boat rotative mount is of substantial weight.

Figure 3A:
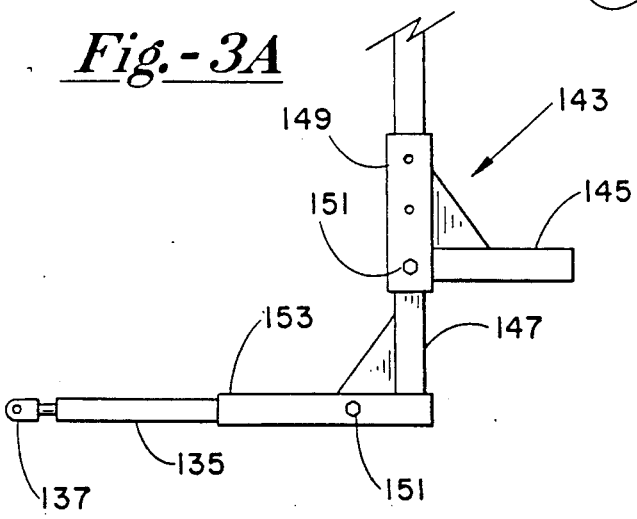
FIG. 3A is a side elevation of an alternative front-end connecting arm which is adapted for use with the front support frame of my new Boat Rotative Mount.

As shown in FIG. 3A, an alternative adjustable link 143 may be used to accommodate smaller boats and boat trailers which ride lower to the ground, consequently lowering the relative position of the boats front support eye 139 relative to frame 3. Adjustable link 143 has an insertable bracket 145 which replaces extensible member 135 and is telescopically insertable in lockable relation within tubular sleeve 133 of bracket 123. Bracket 145 slidably carries a vertically adjustable member 147 within sleeve 149. Member 147 may be locked in any desired position via locking bolts 151. On the bottom end of adjustable member 147 is connected another tubular sleeve 153 which is horizontally disposed and has similar dimensions as tubular sleeve 133 of bracket 123 which is connected to T-bar 93. Tubular sleeve 153 extends outwardly toward the boat and is constructed to receive telescopically therewithin extensible connecting arm 135. Arm 135 may be locked in any desired position via a similar locking bolt 151 on sleeve 153. It can readily be seen from FIG. 3A that the alternative link 143 is adjustable both horizontally and vertically to further accommodate a wide variety of boat sizes.

Figure 3B:
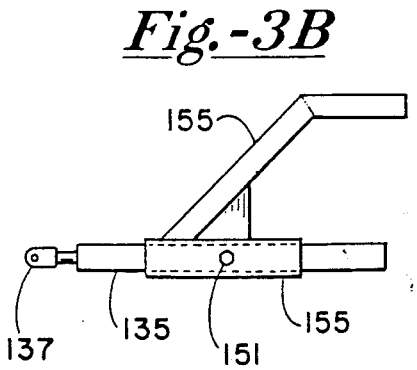
FIG. 3B is a side elevation of another alternative construction of the front-end connecting arm which is adopted for use with the front support frame of my new Boat Rotative Mount.

Shown in FIG. 3B in another alternative front end adjustible link, similar to that shown in FIG. 3A. In this embodiment, the adjustible link has an angularly depending connecting arm 155 which is designed to be telescopically insertable and lockable within bracket 123 on the front support frame 3. Preferably, the angularly depending portion of arm 155 which is designed to be telescopically insertable and lockable within bracket 123 on the front support frame 3. Preferably, the angularly depending portion of arm 155 extends downwardly from the horizontal at approximately 45°.

Connected to the lower end of connecting arm 155 is a sleeve 157 into which extensible connecting arm 135 with rotatable head 137 may be received telescopically. Connecting arm 135 may be adjusted within sleeve 157 and locked into its desired position via suitable locking bolts 151.

From the above description, it is readily apparent that once a boat 2 has been removed from the water and rests upon its boat trailer 4, the rear and front support frames 1 and 3 of my improved boat rotative mount may be easily moved into proper position and adjusted accordingly so as to be readily capable of connecting the respective connecting arms to the support eyes of the boat. The support frames 1 and 3 may be properly positioned without removal of the boat from the boat trailer. Once the connecting arms are connected to the support eyes of the boat 2, the boat 2 may be hoisted from the boat trailer 4 and the boat trailer 4 may be removed by simply pulling the same through a passageway 5 defined by the front support frame 3. Once the boat trailer 4 has been removed, through the use of crank 85, the boat may be rotated about its longitudinal axis in either direction at least 180°. Both the exterior and interior of the boat 2 are readily accessible through the use of my improved boat rotative mount, because the boat is supported solely by the support eyes thereof.

It is important to note that each support frame 1 and 3 is capable of being readily broken down and reassembled as desired. Each frame 1 and 3 is generally comprised of a plurality of bracket or sleeve-type members, with insertable portions extending therefrom to complete the construction thereof. Each frame can be disassembled into smaller and easier to handle components, and can be re-assembled and locked together via locking bolts which are shown in a plurality of positions in the accompanying drawings.

In considering this invention, it should be noted that the present disclosure is illustrative only and the scope of the invention should be determined by the appended claims.

What is claimed is:

1. An apparatus for use in lifting a boat from a boat trailer and suspending the boat from a support eye at its front end and a pair of spaced support eyes at its rear end, and rotating the boat about its longitudinal axis therebetween, comprising:

(a) a pair of rigid adjustable support members being disposed at opposite front and rear ends of the boat, said support members having a structure which is constructed and arranged to respectively engage the pair of support eyes on the rear end of the boat and the support eye on the front end of the boat when the boat is on its boat trailer so as to support the boat solely thereby and facilitate lifting of the same;

(b) one of said support members including a boat rotating means which is constructed and arranged to engage and controllably rotate the boat about its longitudinal axis in either direction (c) one of said support members defining a passage way having an axis of passage which is substantially parallel with an axis extending through and between said front and rear support members whereby the trailer may be removed through said passage way; and

2. The structure defined in claim 1, wherein said support members are readily transportable and movable.

3. The structure defined in claim 1, wherein said support member which is disposed at the rear end of the boat carries said rotating means, said rotating means comprising a gear mechanism which is connected to the support eyes on the rear end of the boat for causing rotation of the boat.

4. The structure defined in claim 3, wherein said rotating means includes a pair of connecting arms which are rotatably connected to the support eyes on the rear end of the boat.

5. The structure defined in claim 4, wherein said connecting arms are reversible and adjustable to accommodate varying sizes of boats.

6. The structure defined in claim 1, wherein said rotating means is mounted on a vertically movable sleeve which is carried by one of said support members, said support member carrying said rotating means including a hoist means connected to said sleeve for moving same up and down so as to raise and lower the boat engaged thereby.

7. The structure defined in claim 1, wherein each of said support members includes a hoist means for causing vertical movement of the boat.

8. The structure defined in claim 1, wherein said support member carrying said rotating means is comprised further of:

(c) a rigid horizontally disposed movable supporting base having length-adjustable diverging legs;

(d) a vertically disposed rigid mast carried by said base; and (e) a controllably slidable sleeve carried by said mast for mounting said rotating means thereon in vertically movable and rotatable relation to said mast.

9. The structure defined in claim 8, including a boom connected to said mast and extending outwardly therefrom in the general direction of the boat to be supported by said support members.

10. The structure defined in claim 1, wherein said support members rotatably engage the support eyes on the front and rear ends of the boat.

11. The structure defined in claim 1, wherein one of said support members defines an archway path which is constructed and arranged to receive at least a boat trailer therethrough.

12. An apparatus for use in suspending a boat by its support eyes and rotating the boat about its longitudinal axis between its rear and front end, comprising:

(a) an upstanding rigid front end support member having a generally inverted U-shaped construction and defining a passageway through itself, and slidably carrying in controllable relation an outwardly extending adjustable front end connecting arm;

(b) an upstanding rigid rear end support member slidably carrying in controllable relation a boat rotating means, said boat rotating means having a pair of outwardly extending adjustable rear end connecting arms;

(c) said connecting arms each having freely rotatable end portions which are constructed and arranged to engage the support eyes of the boat while remaining freely rotatable; and (d) said support members and said rotating means being constructed and arranged to hoist, suspend and rotate the boat in either direction about its longitudinal axis.

13. The structure defined in claim 12, wherein said rotating means is constructed and arranged to rotate the boat about its longitudinal axis at least 180° in either direction.

14. The structure defined in claim 12, wherein each support member is transportable and the rear end support member has a horizontally disposed A-frame base which has diverging adjustable legs opening toward the boat that is to be support thereby, said legs being constructed and arranged to support and balance the boat as it is rotated about its longitudinal axis.

15. The structure defined in claim 12, wherein each support member has a hoist means for raising and lowering their respective connecting arms carried thereby.

16. The structure defined in claim 12, wherein said rotating means is mounted on a sleeve which is slidably carried for controlled vertical movement by said rear end support member.

17. The structure defined in claim 12, wherein said rotating means is controlled through a locking gear crank means.

18. The structure defined in claim 12, wherein said rear end connecting arms are reversible so as to be capable of accommodating varying sizes of boats.

19. The structure defined in claim 12, wherein at least one of said support members are constructed and arranged to define an archway path for accommodating and receiving a boat trailer therethrough.

20. An apparatus for use in lifting a boat from a boat trailer and suspending the boat at its opposite front and rear ends by its support eyes for rotating same about its longitudinal axis, comprising:

(a) a pair of rigid adjustable support members connected to the opposite front and rear ends of the boat in boat rotating relation;

(b) a boat rotating means mounted on one of said support members, said rotating means being constructed and arranged to engage and controllably rotate the boat in either direction about an axis extending through and between said support members; and (c) at least one of said support members having structure defining a passageway through itself to accommodate and receive the boat trailer which carries the boat so as to allow positioning of said support members in proper boat-connecting-and-supporting relation while the boat remains on the trailer, and to facilitate removal of the boat trailer therethrough once the boat is hoisted from the trailer, said passageway having an axis of passage which is substantially parallel with said axis extending between said support members.

21. The structure defined in claim 20, wherein said support members are constructed and arranged to connect to the support eyes on opposite ends of the boat.

22. The structure defined in claim 20, wherein said support members are constructed and arranged to rotatably connect to the support eyes on opposite ends of the boat.

23. The structure defined in claim 20, wherein one of said support members defines an archway for receiving the boat trailer carrying the boat therethrough.

24. The structure defined in claim 23, wherein said support member disposed at the front end of the boat defines said archway.

25. The structure defined in claim 20, wherein said front and rear support members have base members with length-adjustible legs.

* * * * *